US007793705B2

(12) United States Patent
Kuo

(10) Patent No.: US 7,793,705 B2
(45) Date of Patent: Sep. 14, 2010

(54) CASTING DIE WITH CHANGEABLE MALE AND FEMALE DIE CORES

(76) Inventor: Fei-Pin Kuo, No. 45, Lane 428, Jhongjheng N. Rd., Sanchong City, Taipei County (TW)

( * ) Notice: Subject to any disclaimer, the term of this patent is extended or adjusted under 35 U.S.C. 154(b) by 565 days.

(21) Appl. No.: 11/837,068

(22) Filed: Aug. 10, 2007

(65) Prior Publication Data

US 2009/0038368 A1 Feb. 12, 2009

(51) Int. Cl.

| | |
|---|---|
| ***B22D 17/22*** | (2006.01) |
| ***B22D 17/26*** | (2006.01) |
| ***B22D 33/04*** | (2006.01) |
| ***B29C 45/26*** | (2006.01) |
| ***B29C 45/64*** | (2006.01) |

(52) U.S. Cl. ..... 164/340; 164/341; 164/342; 164/347; 425/190; 425/192 R

(58) Field of Classification Search ..... 164/339, 164/340, 341, 342, 344, 345, 347, 137; 425/190, 425/192 R See application file for complete search history.

(56) References Cited

U.S. PATENT DOCUMENTS 5,916,603 A * 6/1999 Pleasant et al. ..... 425/182

* cited by examiner

*Primary Examiner*—Kevin P Kerns
(74) *Attorney, Agent, or Firm*—Guice Patents PLLC

(57) ABSTRACT

A press casting die able to change its female and male die cores, in which mainly a movable-side fixed plate of a die seat is provided behind a male-die recess with a plate receiving recess of a larger area, the plate receiving recess can be mounted therein with a changeable pressure bearing plate having thereon holes for insertion of pushing-out pins, the pressure bearing plate is abutted against by a pair of die-foot blocks in its rear to thereby have sufficient bearing capability to assure its durability for a high pressure in material injection. Therefore, when life of use of the die cavity is exhausted, only the female die core, the male die core and the pressure bearing plate are necessarily changed, thereby the cost of the die is largely reduced, and benefit of environmental conservation can be provided.

9 Claims, 7 Drawing Sheets

CASTING DIE WITH CHANGEABLE MALE AND FEMALE DIE CORES

BACKGROUND OF THE INVENTION

1. Field of the Invention

The present invention relates to a press casting die, and especially to a brand new structure of a press casting die with changeable male and female die cores.

2. Description of the Prior Art

The technique of press casting with a die is a conventionally used technique in manufacturing industry, e.g., using zinc magnesium alloy to produce an electronic housing with high quality, needs only to have a die well designed, the alloy can be injected with high pressure into the die to produce an article very fast. A conventional press casting die generally has a die seat at a stationary side and a die seat at a movable side thereof; the die seat at the stationary side is fixed, while the die seat at the movable side can be assembled in a movable mode, the movable side can move closer to or away from the stationary side along its moving direction to do the processes of die closing, injection and die releasing etc.

FIG. 1 shows a conventional press casting die, in which a die seat 91 at a stationary side is composed of a stationary-side fixed plate 911 and a female die core 912, the female die core 912 is locked with screws 913 in a female-die recess 914 in the stationary-side fixed plate 911; and the stationary-side fixed plate 911 is provided thereon with a material injection opening 915.

A die seat 92 at a movable side of the press casting die has a movable-side fixed plate 921 and a male die core 922 provided in opposition to the stationary-side fixed plate 911, the male die core 922 is locked with screws 923 in a male-die recess 924; and a guiding protrusion 925 is provided on the movable-side fixed plate 921 and in opposition to the material injection opening 915, the guiding protrusion 925 is provided on its lower bottom side with a guiding recess 925*a* in order that injected alloy can be injected therein and through a material injecting channel 922*a* of the male die core 922 into a die cavity between the male die core 922 and the female die core 912 to form a shaped article.

The die seat 92 at a movable side further is provided with a top plate set 926 which is limited to move between a pair of die-foot blocks 928; in releasing the die, the top plate set 926 gets close to the movable-side fixed plate 921, a plurality of pushing-out pins 927 on the movable-side fixed plate 921 will be extended through a plurality of through holes 929 of to the movable-side fixed plate 921 to push the shaped article out of the male die core 922 for collection.

In such a structure of the conventional press casting die, the average times of use before necessary changing of the male die core 922 and the female die core 912 is about 50~80 thousands, otherwise, the surfaces of the die cavity between the die cores 922 and 912 when being used for about 80 thousand times will crack, and their outer edges will generate a phenomenon of having extreme serious rough edges; thus its material spilling area gets larger to affect the quality of the injected material, in this case, the entire die must be changed for a new one.

In the structure of the die seat 92 at the movable side, by virtue that the movable-side fixed plate 921 and the male die core 922 shall be drilled to have the through holes 929 and the drill holes, when the male die core 922 is to be changed, the movable-side fixed plate 921 must be changed too at the same time, this will increase the cost, the cost is awfully increased especially in the present days with material's prices going up to such high levels; and this further induces environmental problems, in view of these, improvement is wanted.

And more, in manufacturing some other article, with such a conventional structure of die, the whole set of die often needs to be changed. The reason of this is resided in that, when the female die core 912 and the male die core 922 respectively in the die seat 91 at a stationary side and in the die seat 92 at the movable side must be drilled to get a plurality of new screw holes to release the die; these new screw holes will overlap with the old screw holes, thus the die seat 92 at the movable side and the die seat 91 at a stationary side will be damaged and not suitable for use. In view of this, the conventional die is unable to change for a new male die core and a new female die core, and this is a problem that the present invention is to clear up.

SUMMARY OF THE INVENTION

In view of the above defect that the conventional press casting die is unable to change for a new male die core and a new female die core, the present invention provides a press casting die able to change its die cores for a new male die core and a new female die core, in which mainly a movable-side fixed plate of a die seat is provided behind a male-die recess with a plate receiving recess of a larger area, the plate receiving recess can be mounted therein with a changeable pressure bearing plate having thereon a plurality of holes for insertion of pushing-out pins, the pressure bearing plate is abutted against by a pair of die-foot blocks in its rear to thereby have sufficient bearing capability to assure its durability for a high pressure in material injection. Therefore, when life of use of the die cavity is exhausted, only the female die core, the male die core and the pressure bearing plate are necessarily changed, in this way, the cost of the die is largely reduced, and benefit of environmental conservation can be provided.

By virtue that in alloy injection, the range of pressure able to be born by the pressure bearing plate is about 50 $kg/cm^3$~300 $kg/cm^3$, the two die-foot blocks are abutted against meeting areas between the pressure bearing plate and the two lateral edges of the plate receiving recess of the movable-side fixed plate, in order to brace the pressure bearing plate; meantime, a top plate set is provided at its four corners each with a pressure supporting post having therein a central screw for screw locking areas of the movable-side fixed plate near the lateral sides of the plate receiving recess, so that the end faces of the pressure supporting posts are also abutted against the meeting areas between the pressure bearing plate and the upper and lower sides of the plate receiving recess to provide sufficient supporting forces.

The present invention will be apparent in its structure and effect in use after reading the detailed description of the preferred embodiment thereof in reference to the accompanying drawings.

DETAILED DESCRIPTION OF THE PREFERRED EMBODIMENT

Figure 1:
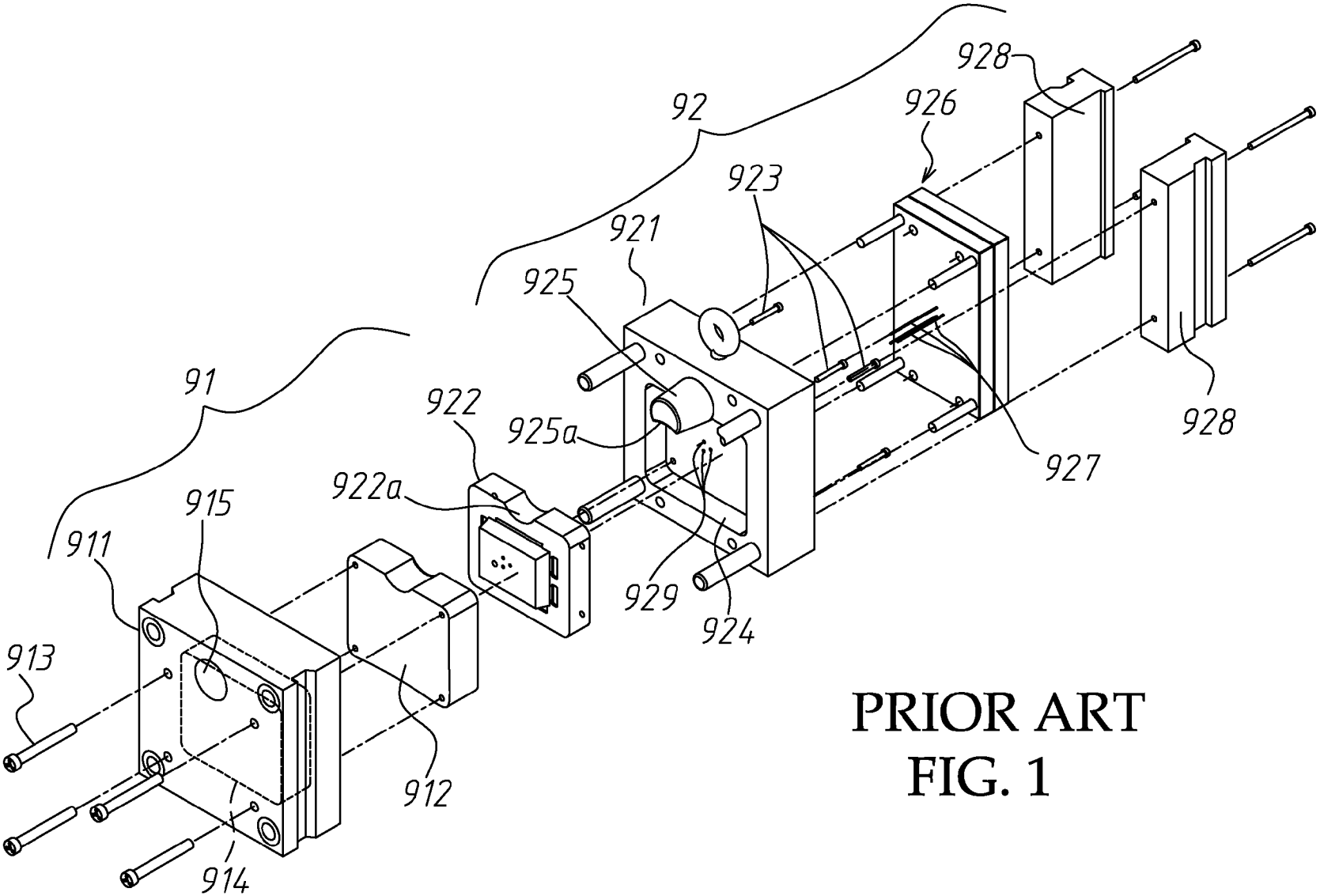
PRIOR ART FIG. 1
FIG. 1 is an anatomic perspective view of a conventional press casting die.
Figure 2:
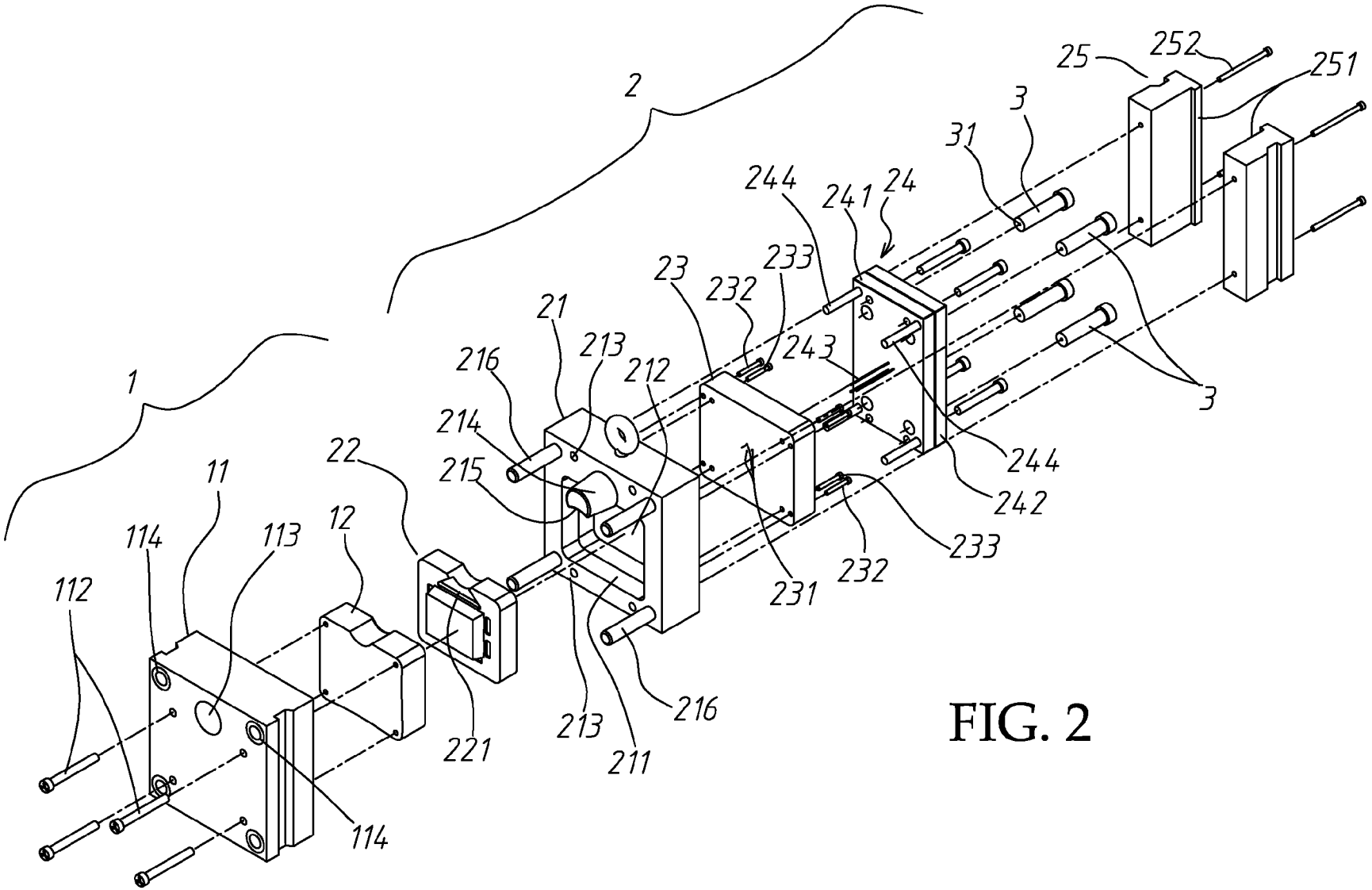
FIG. 2 is an anatomic perspective view of the present invention.
Figure 3:
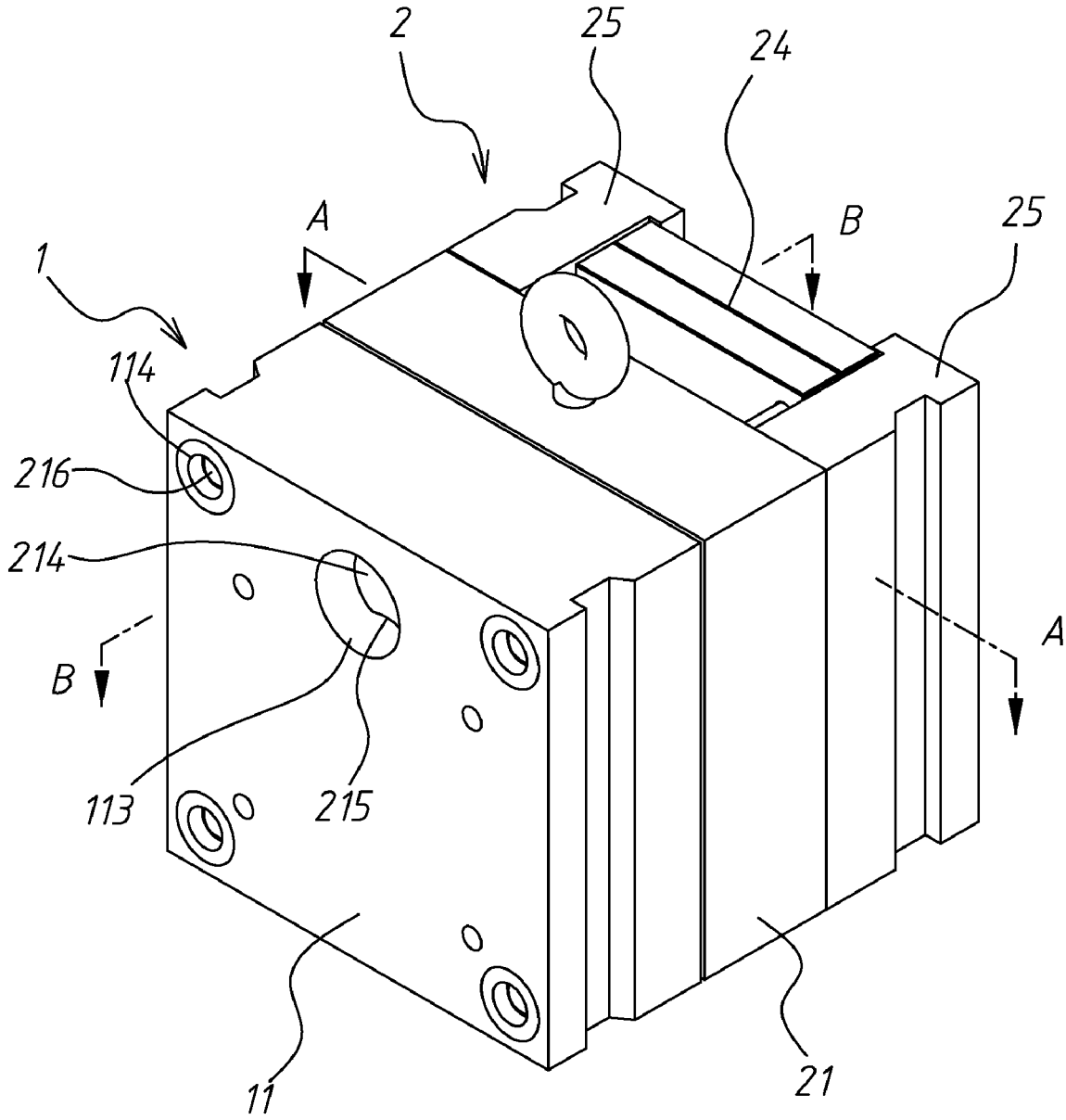
FIG. 3 is a perspective view after assembling of the present invention.
Figure 4:
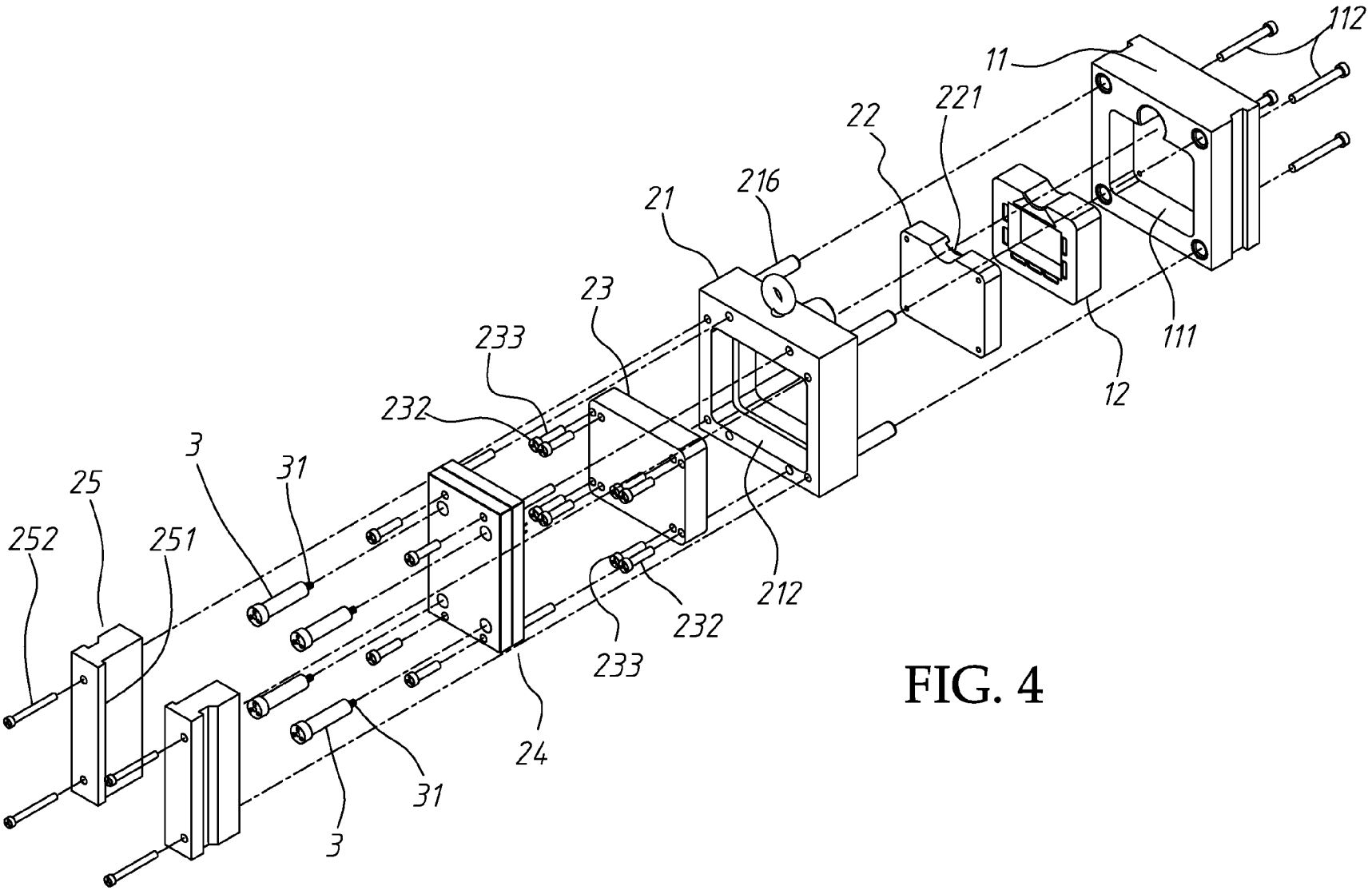
FIG. 4 is an anatomic perspective view of the present invention viewing from a contrary direction to that of FIG. 2.
Figure 5:
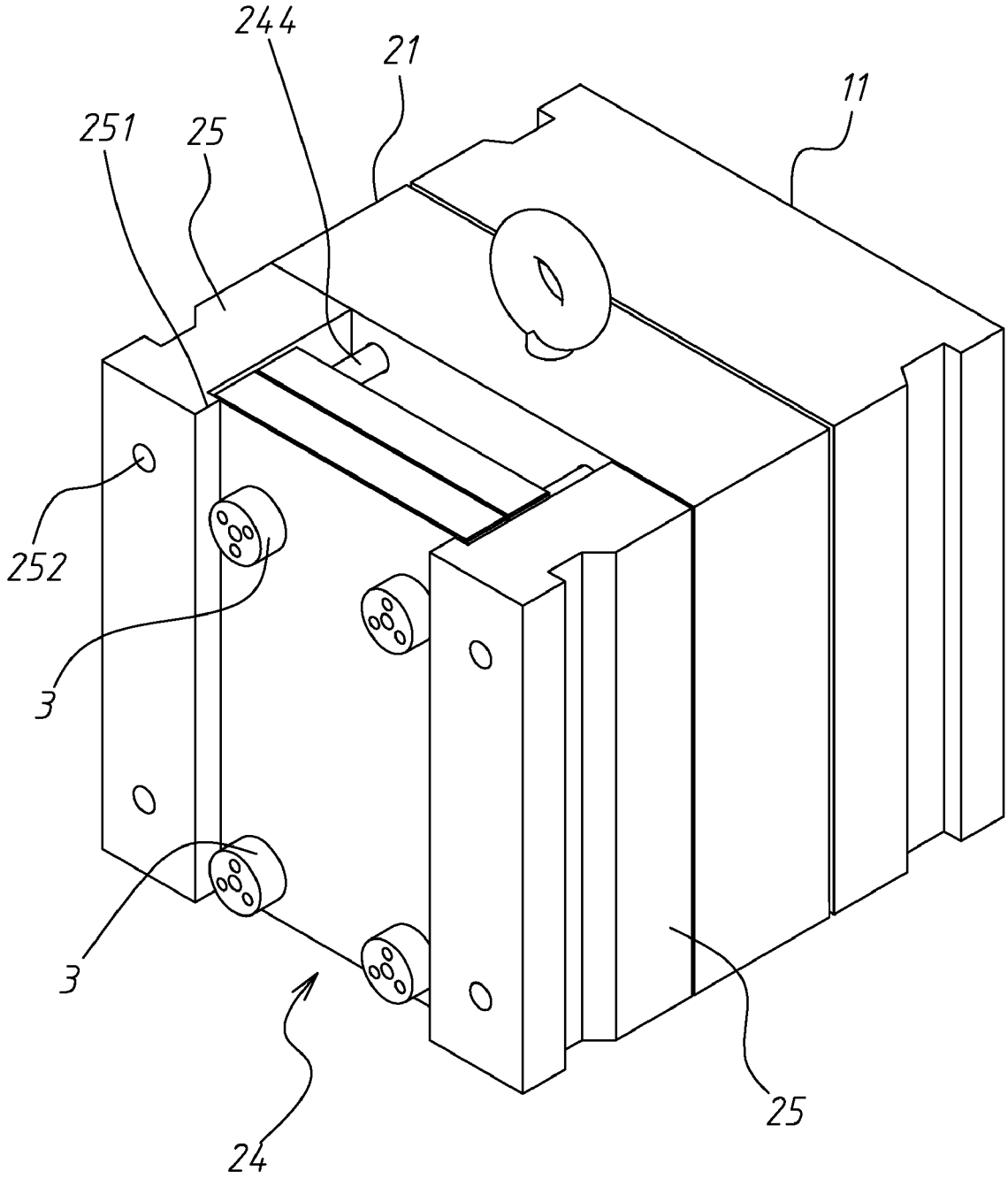
FIG. 5 is a perspective view after assembling of the present invention viewing from a contrary direction to that of FIG. 3.

Referring to FIGS. 2-5, a press casting die provided in the present invention mainly is composed of a die seat 1 at a stationary side and a die seat 2 at a movable side thereof. The die seat 1 at the stationary side is fixed, while the die seat 2 at the movable side is mounted displaceably in order that the die seat 2 can be displaced to be close to or away from the die seat 1 to do the processes of die closing, injection and die releasing etc.

The die seat 1 at the stationary side of the present invention is provided mainly with a stationary-side fixed plate 11 having on its inner side a female-die recess 111 to receive a changeable female die core 12; four inside corners of the female-die recess 111 of the stationary-side fixed plate 11 are provided each with a screw 112 to lock a female die core 12 but to keep the function of changing. The stationary-side fixed plate 11 has thereon a material injection opening 113, and has on each of its four corners a guide-rod hole 114.

The die seat 2 at the movable side is composed of a movable-side fixed plate 21, a male die core 22, a pressure bearing plate 23, a top plate set 24 and a pair of die-foot blocks 25.

The movable-side fixed plate 21 is formed on its inner side a male-die recess 211 able to receive the changeable male die core 22, the male-die recess 211 has behind it a plate receiving recess 212 of a larger area, the plate receiving recess 212 can be mounted therein with the changeable pressure bearing plate 23 having thereon a plurality of holes 231 for insertion of pushing-out pins. The pressure bearing plate is provided at its four corners each with an outer screw 232 and an inner screw 233; the outer screws 232 are used to lock the pressure bearing plate 23 in the plate receiving recess 212 of the movable-side fixed plate 21, while the inner screws 233 are used to lock the male die core 22 (referring to FIG. 6). The movable-side fixed plate 21 is provided at its four corners each with a guiding hole 213. The upper edge of the male-die recess 211 of the movable-side fixed plate 21 is provided with a guiding protrusion 214 which is extended into the material injection opening 113 of the stationary-side fixed plate 11 when in material injecting; the guiding protrusion 214 is provided on its lower bottom side with a guiding recess 215 in order that injected material can be injected therein and through a material injecting channel 221 of the male die core 22 into a die cavity between the female and the male die cores 12, 22. The movable-side fixed plate 21 is provided at its four corners each with a fixed-plate guide rod 216, in closing the die, the fixed-plate guide rod 216 is extended into a corresponding guide-rod hole 114 of the stationary-side fixed plate 11.

The top plate set 24 is composed of an inner and an outer top plate 241, 242; its width is smaller and its height is larger respectively than those of the pressure bearing plate 23, and it is provided behind the pressure bearing plate 23; the outer top plate 242 is provided with a plurality of pushing-out pins 243 in corresponding with the holes 231 respectively. The top plate set 24 is further provided at its four corners each with a top-plate guiding post 244; when the top plate set 24 gets close to the movable-side fixed plate 21 to push out an article with the pushing-out pins 243, the top-plate guiding posts 244 will be extended into the guiding holes 213 respectively provided at the four corners of the movable-side fixed plate 21.

Figure 6:
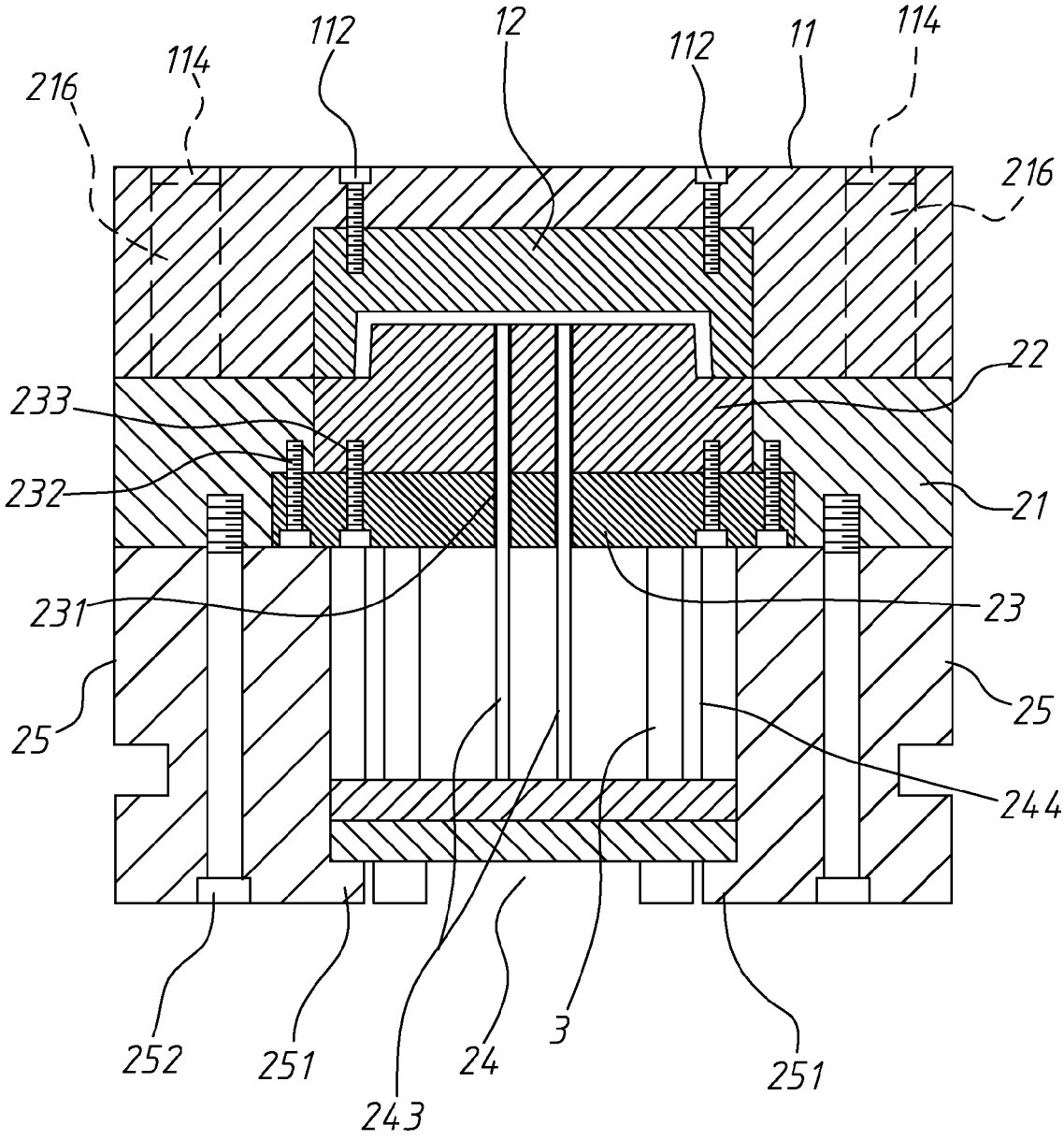
FIG. 6 is a sectional view taken at a sectional line A-A in FIG. 3 of the present invention.
Figure 7:
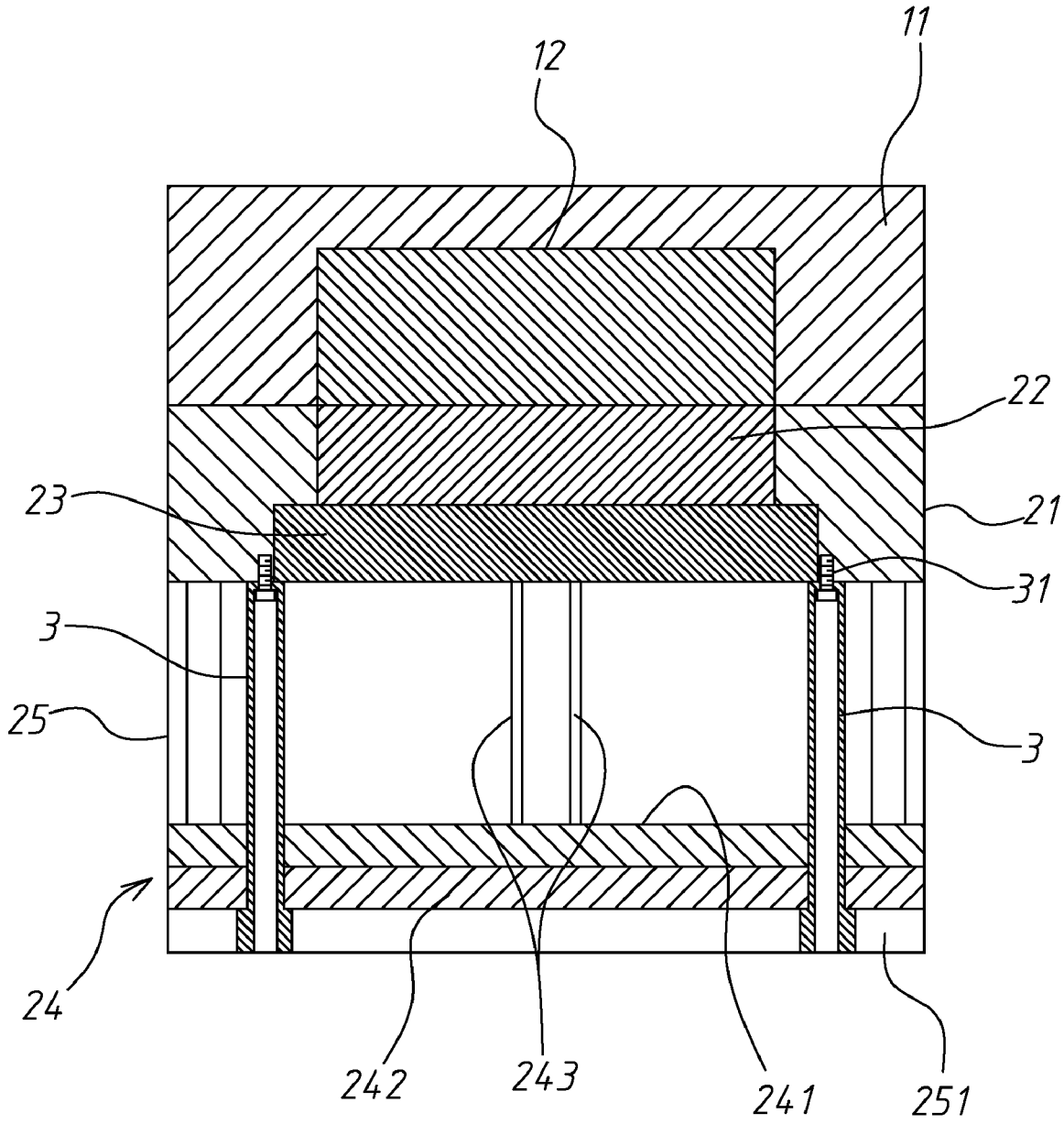
FIG. 7 is a sectional view taken at a sectional line B-B in FIG. 3 of the present invention.

The top plate set 24 is provided in its rear with a pair of die-foot blocks 25 to provide supporting forces for the pressure bearing plate 23 when in injection, the die-foot blocks 25 are formed on their rear ends flanges 251 to prevent rearward moving of the top plate set 24. The die-foot blocks 25 are locked onto the movable-side fixed plate 21 with bolts 252. Referring to FIG. 6, the die-foot blocks 25 are abutted against meeting areas between the pressure bearing plate 23 and the two lateral edges of the plate receiving recess 212 of the movable-side fixed plate 21. In addition to this, the top plate set 24 is provided at its four corners each with a pressure supporting post 3 having therein a central screw 31 for abutting against the areas of the movable-side fixed plate 21 near the lateral sides of the plate receiving recess 212, so that the end faces of the pressure supporting posts 3 are also abutted against the meeting areas between the pressure bearing plate 23 and the upper and lower sides of the plate receiving recess 212 to provide sufficient supporting forces as shown in FIG. 7.

In the process of press casting, the die seat 2 at the movable side is displaced to get close to the die seat 1 at the stationary side, then alloy is injected into the material injection opening 113 of the stationary-side fixed plate 11 and through the guiding recess 215 of the movable-side fixed plate 21 to get into the die cavity between the female and the male die cores 12, 22 to form an article. After that, the die seat 2 at the movable side is displaced to get away from the die seat 1 at the stationary side to release the die; the article then gets through the pressure bearing plate 23 by the action of the pushing-out pins 243 pushed by the top plate set 24 (referring to FIG. 6 wherein the top plate set 24 moves upwards), the male die core 22 pushed out then is recollected.

One thing worth noticing, the pressure bearing plate 23 on the movable-side fixed plate 21 of the die seat 2 at the movable side in the present invention is detachable, this renders the male die core 22 on the movable-side fixed plate 21 at the movable side and the female die core 12 on the stationary-side fixed plate 11 both able to be detached for changing. Thereby, when the die cavity is exhausted in its life of use, only the female die core 12, the male die core 22 and the pressure bearing plate 23 are necessarily changed, in this way, the cost of the die is largely reduced, and benefit of environmental conservation can be provided.

Additionally, by the specific design of positions of the pressure supporting posts 3 and the die-foot blocks 25 in the rear of the movable-side fixed plate 21, the pressure bearing plate 23 has sufficient bearing capability to assure its durability for the pressure in material injection, and thereby stability and safety of the article can be preserved.

In conclusion, according to the description disclosed above, the press casting die having the changeable male die core, female die core of the present invention is patentable in the light of the above teachings.

The invention claimed is:

1. A press casting die being adapted to changing its male and female die cores, said press casting die comprises:

a die seat at a stationary side having a stationary-side fixed plate having a female-die recess located on an inner side thereof and a female die core located in the female-die recess and being changeable; and a die seat at a movable side having a movable-side fixed plate having a male-die recess located on an inner side thereof and a male die core located in the male-die recess, said male-die core being changeable, said movable-side fixed plate having a plate receiving recess located on a side opposite said male-die recess, said plate receiving recess communicating with said male-die recess, said plate receiving recess has a plate recess area larger than a male-die recess area of said male-die recess, a pressure bearing plate being changeable and located in said plate receiving recess, said pressure bearing plate having a plurality of holes for insertion of pushing-out pins; said pressure bearing plate has four corners, each corner of the four corners has an outer screw and an inner screw; each said outer screw of the four corners selectively locking said pressure bearing plate in said plate receiving recess of said movable-side fixed plate, said inner screws selectively locking said male die core in said male-die recess of said movable-side fixed plate;

a top plate set having an inner top plate and an outer top plate, said top plate set having a width that is smaller than a width of said pressure bearing plate and a height that is larger than a height of said pressure bearing plate, and said top plate set is provided behind said pressure bearing plate, wherein said outer top plate is provided with a plurality of pushing-out pins corresponding with said plurality of holes of said pressure bearing plate respectively; and a pair of die-foot blocks located on opposing sides of said top plate set and providing supporting forces for said pressure bearing plate when in injection;

wherein, said die seat at said movable side is displaced to move towards said die seat at said stationary side, then alloy is injected into a die cavity between said female and said male die cores to form an article; after that, said die seat at said movable side is displaced to move away from said die seat at said stationary side to release said die; said article then gets released by said pressure bearing plate by action of said pushing-out pins pushed by said top plate set and is pushed out of said male die core; wherein said male die core of said die seat at said movable side, said pressure bearing plate and said female die core in said die seat at said stationary side are all adapted to being detached for changing.

2. The press casting die being adapted to changing its male and female die cores as claimed in claim 1, wherein said two die-foot blocks are abutted against meeting areas between said pressure bearing plate and two lateral edges of said plate receiving recess of said movable-side fixed plate.

3. The press casting die being adapted to changing its male and female die cores as claimed in claim 2, wherein said die-foot blocks are formed on their rear ends flanges to prevent rearward moving of said top plate set.

4. The press casting die being adapted to changing its male and female die cores as claimed in claim 1, wherein said top plate set has a pressure supporting post located at each corner of four corners thereof and each said pressure supporting post having therein a central screw for screw locking to areas of said movable-side fixed plate near lateral sides of said plate receiving recess, end faces of said pressure supporting posts are abutted against meeting areas between said pressure bearing plate and an upper and a lower side of said plate receiving recess to provide sufficient supporting forces.

5. The press casting die being adapted to changing its male and female die cores as claimed in claim 4, wherein said top plate set has a top-plate guiding post located at each corner of said four corners thereof; when said top plate set gets moves toward said movable-side fixed plate said article is pushed out with said pushing-out pins, said top-plate guiding posts are extended into said guiding holes respectively provided at four corners of said movable-side fixed plate.

6. The press casting die being adapted to changing its male and female die cores as claimed in claim 1, wherein said stationary-side fixed plate of said die seat at said stationary side has thereon a material injection opening, and an upper edge of said male-die recess of said movable-side fixed plate is provided with a guiding protrusion which is extended into said material injection opening; said guiding protrusion is provided on a lower bottom side thereof with a guiding recess in order that injected material is injected therein and through a material injecting channel of said male die core into a die cavity between said female and said male die cores.

7. The press casting die being adapted to changing its male and female die cores as claimed in claim 1, wherein said stationary-side fixed plate has a guide-rod hole located on each corner of four corners thereof, and said movable-side fixed plate has four fixed-plate guide rods, one fixed-plate guide rod of said four fixed-plate guide rods is located on each corner of four corners thereof, in closing said die, one fixed-plate guide rod of said fixed-plate guide rods is extended into each said guide-rod holes.

8. The press casting die being adapted to changing its male and female die cores as claimed in claim 1, wherein four inside corners of said female-die recess of said stationary-side fixed plate are provided each with a screw to lock said female die core.

9. The press casting die being adapted to changing its male and female die cores as claimed in claim 1, wherein said male-die core and said pressure bearing plate are removably fixed in said movable-side fixed plate.

* * * * *